US011445830B2

(12) United States Patent
Mantzis

(10) Patent No.: US 11,445,830 B2
(45) Date of Patent: Sep. 20, 2022

(54) MATRESS

(71) Applicant: Mantzis Holdings Pty Ltd., Victoria (AU)

(72) Inventor: Vasilios George Mantzis, Victoria (AU)

(73) Assignee: MANTZIS HOLDINGS PTY LTD., Victoria (AU)

( * ) Notice: Subject to any disclaimer, the term of this patent is extended or adjusted under 35 U.S.C. 154(b) by 469 days.

(21) Appl. No.: 15/739,244

(22) PCT Filed: Dec. 14, 2016

(86) PCT No.: PCT/AU2016/051233
§ 371 (c)(1),
(2) Date: Nov. 13, 2018

(87) PCT Pub. No.: WO2017/100844
PCT Pub. Date: Jun. 22, 2017

(65) Prior Publication Data

US 2018/0368583 A1 Dec. 27, 2018

(30) Foreign Application Priority Data

Dec. 14, 2015 (AU) ..... 2015905161

(51) Int. Cl.
*A47C 27/06* (2006.01)
*A47C 27/07* (2006.01)

(52) U.S. Cl.
CPC ..... *A47C 27/064* (2013.01); *A47C 27/07* (2013.01)

(58) Field of Classification Search
CPC ..... A47C 27/07; A47C 27/064
See application file for complete search history.

(56) References Cited

U.S. PATENT DOCUMENTS 685,160 A * 10/1901 Marhsall ..... A47C 27/064 5/720
1,455,847 A * 5/1923 Meutsch ..... A47C 27/04 5/720

(Continued)

FOREIGN PATENT DOCUMENTS

EP 0453363 A1 * 10/1991
FR 2799622 A1 * 4/2001 ..... A47C 27/064

(Continued)

OTHER PUBLICATIONS

International Search Report PCT/AU2016/051233 dated Feb. 10, 2017.

*Primary Examiner* — David R Hare
*Assistant Examiner* — Alexis Felix Lopez
(74) *Attorney, Agent, or Firm* — Pillsbury Winthrop Shaw Pittman, LLP

(57) ABSTRACT

A mattress includes an outer casing, and an inner core that is surrounded by the outer casing. The mattress has two major faces, two long side faces, and two end faces. The inner core includes a plurality of pocket springs that each have at least one spring within a fabric pocket. Each spring is compressible along a compressive axis, and the pocket springs are arranged within the core such that the compressive axes extend perpendicularly to the two major faces. The pocket springs are arranged into two lateral sets, and a central set. In each lateral set, the fabric pockets of adjacent pocket springs are interconnected in regions adjacent the major faces of the mattress. In the central set, the fabric pockets of adjacent pocket springs are interconnected in regions adjacent the major faces of the mattress. The central set is disposed between the two lateral sets, and extends in a direction parallel to the long side faces of the mattress. The central set is joined directly or indirectly to each of the two lateral sets by first connections that are disposed substan- (Continued)

tially centrally between the two major faces, such that springs in each lateral set are compressible independently of the springs in the other lateral set.

16 Claims, 8 Drawing Sheets

(56) References Cited

U.S. PATENT DOCUMENTS 1,747,374 A * 2/1930 Macinerney ..... A47C 27/062 5/655.8
1,914,661 A * 6/1933 Burke ..... A47C 27/001 5/722
2,862,214 A * 12/1958 Thompson ..... A47C 27/04 5/720
3,191,197 A * 6/1965 Frey ..... A47C 27/144 5/243
4,439,977 A * 4/1984 Stumpf ..... A47C 27/064 156/200
4,907,309 A * 3/1990 Breckle ..... A47C 27/063 5/720
5,127,635 A * 7/1992 Long ..... A47C 27/063 267/91
5,239,715 A * 8/1993 Wagner ..... A47C 27/066 5/717
5,885,407 A * 3/1999 Mossbeck ..... A47C 27/064 156/556
5,953,778 A * 9/1999 Hiatt ..... A47C 27/001 5/722
5,957,438 A * 9/1999 Workman ..... A47C 27/063 267/90
6,684,435 B1 * 2/2004 Wells ..... A47C 27/062 5/248
6,813,791 B2 * 11/2004 Mossbeck ..... A47C 27/064 5/716
7,757,322 B2 * 7/2010 An ..... A47C 27/001 5/722
8,117,700 B2 * 2/2012 Howard ..... A47C 27/001 5/690
8,474,078 B2 * 7/2013 Mossbeck ..... A47C 27/053 5/716
2013/0232699 A1 * 9/2013 Hinshaw ..... A47C 27/05 5/717
2020/0029703 A1 * 1/2020 Alletto, Jr. ..... A47C 23/00

FOREIGN PATENT DOCUMENTS

GB 431038 A * 6/1935 ..... A47C 27/04
GB 2547336 A * 8/2017 ..... A47C 27/064
JP H0889367 A * 4/1996

* cited by examiner

MATRESS

CROSS-REFERENCE TO RELATED APPLICATIONS

This application is the U.S. National Phase of PCT/AU2016/051233 filed Dec. 14, 2016, which claims priority to Australian Patent Application No. 2015905161, filed Dec. 14, 2015, the contents of each are incorporated herein by reference in entirety.

FIELD OF THE INVENTION

The present invention relates to a mattress of a type that is intended to accommodate two people sleeping simultaneously.

BACKGROUND

It is common in many developed countries, including Australia, for beds to be of a sufficient width to accommodate two people sleeping side-by-side simultaneously. To this end, there are at least three length/width combinations of bedding for this purpose. These being: Double, Queen-size, and King-size.

Mattresses for this type of bed are constructed with a core that can be compressed under load (for example, by the weight of a person lying on the bed), and various covering materials for containing the mattress core and providing comfort/pressure relief to those using the mattress. The mattress core is often made of springs or foam.

One construction of mattress core uses springs that are contained individually (or sometimes in pairs) in a fabric pocket. The fabric pockets are joined to one another to form a large rectangular array of pocketed springs. Peripheral wires extending around the top and bottom major faces hold the pockets together. A mattresses with a core of this construction is known as pocket spring mattress. Where the springs are wire coil springs, such a mattress may alternatively be known as a pocket coil mattress.

Pocket spring mattresses are very popular because the compressive strength of the coils can be selected to suit the part of the person sleeping on the mattress. For instance, the springs in the length-wise central of the mattress may be stiffer than the springs at the crown and foot ends of the mattress, to provide greater support to the hips and lower back of the person lying on the mattress.

The fabric pockets are interconnected such that a point load on one spring causes the neighbouring springs to be deflected. This ensures that neighbouring springs deflect together, and reduces the likelihood of a "lumpy" feeling in the mattress.

It is known that a person moving on one side of the bed can cause the springs on the adjacent side of the bed to deflect. In turn, this deflection can rouse a person sleeping on that adjacent side of the bed, or at least disturb their sleep.

There is a need to address the above, and/or at least provide a useful alternative.

SUMMARY

The present invention provides a mattress comprising an outer casing, and an inner core that is surrounded by the outer casing, the mattress having two major faces, two long side faces, and two end faces, the core including a plurality of pocket springs that each comprise at least one spring within a fabric pocket, each spring being compressible along a compressive axis, and the pocket springs being arranged within the core such that the compressive axes extend perpendicularly to the two major faces, wherein the pocket springs are arranged into:

two lateral sets, wherein in each lateral set the fabric pockets of adjacent pocket springs are interconnected in regions adjacent the major faces of the mattress; and a central set, wherein the fabric pockets of adjacent pocket springs in the central set are interconnected in regions adjacent the major faces of the mattress, the central set being disposed between the two lateral sets, and extending in a direction parallel to the long side faces of the mattress;

and wherein the central set is joined directly or indirectly to each of the two lateral sets by first connections that are disposed substantially centrally between the two major faces, such that springs in each lateral set are compressible independently of the springs in the other lateral set.

The present invention also provides a mattress comprising an outer casing, and an inner core that is surrounded by the outer casing, the mattress having two major faces of which at least one is a sleeping face, two long side faces, and two end faces, the core including a plurality of pocket springs that each comprise at least one spring within a fabric pocket, each spring being compressible along a compressive axis, and the pocket springs being arranged within the core such that the compressive axes extend perpendicularly to the two major faces, wherein the pocket springs are arranged into:

two lateral sets, wherein in each lateral set the fabric pockets of adjacent pocket springs are interconnected in regions adjacent the major faces of the mattress; and a central set, wherein the fabric pockets of adjacent pocket springs in the central set are interconnected in regions adjacent the major faces of the mattress, the central set being disposed between the two lateral sets, and extending in a direction parallel to the long side faces of the mattress;

and wherein the central set is joined directly or indirectly to each of the two lateral sets by first connections that are spaced from the or each sleeping face and wherein the central set is not connected to either lateral set in a region adjacent the or each sleeping face, such that springs in each lateral set are compressible independently of the springs in the other lateral set.

In some preferred embodiments, the core further includes at least two elongate flexible strips, wherein each strip extends between the central set and a respective one of the lateral sets, wherein each of the first connections connects the fabric pockets of the central set with a respective one of the flexible strips, and wherein each strip is joined to the respective lateral set by second connections that are formed in a region adjacent at least one of the major faces of the mattress.

Preferably, the elongate strips each include an inner portion that is disposed between the central set and lateral sets, and at least one outer portion that overlies a portion of the respective lateral set.

In certain embodiments, the second connections are disposed between the respective lateral set and outer portion, and also between the respective lateral set and the adjacent major face of the mattress.

More preferably, the elongate strips each include two outer portions that each overlies portions of the respective lateral set on opposing major faces of the core. In some embodiments, the outer portions overlie at least one row of pocket springs of the respective lateral set that is beside the central set. In certain embodiments, the outer portions substantially overlie at least two row of pocket springs that are beside the central set.

Preferably, each of the second connections connects the outer portion with a fabric pocket. More preferably, each of the second connections is formed at an axial end of the respective pocket spring.

In at least some embodiments, the elongate strips are formed of a fabric.

In certain embodiments, the central set consists of a single row of interconnected pocket springs. In some cases, the central set extends between opposing end faces of the mattress.

Preferably, the central set is formed from a tube of fabric that has seams extending transversely across the tube and between adjacent springs to partition the tube so as to form the fabric pockets. In one example, the fabric includes a plastic material and the seams are created between adjacent springs by a fabric fusing process.

Preferably, the first and second connections are formed with adhesive. In one example, the adhesive is a holt-melt adhesive.

Preferably, the lateral sets are each formed from a plurality of tubes of fabric, each tube having seams extending transversely between adjacent springs to partition the respective tube so as to form the fabric pockets, and wherein the fabric pockets of adjacent pairs of the plurality of tubes are interconnected by a third connections that connect the fabric pockets in regions adjacent the major faces of the mattress.

The tubes of fabric in the lateral sets can be arranged to extend parallel to the end faces of the mattress. Alternatively, the tubes of fabric in the lateral sets can be arranged to extend parallel to the long sides of the mattress.

Preferably, the third connections are formed with adhesive. In one example, the adhesive is a holt-melt adhesive.

In one example, the fabric includes a plastic material and the seams are created between adjacent springs by a fabric fusing process.

BRIEF DESCRIPTION OF THE DRAWINGS

In order that the invention may be more easily understood, embodiments will now be described, by way of example only, with reference to the accompanying drawings, in which.

DETAILED DESCRIPTION

Figure 1:
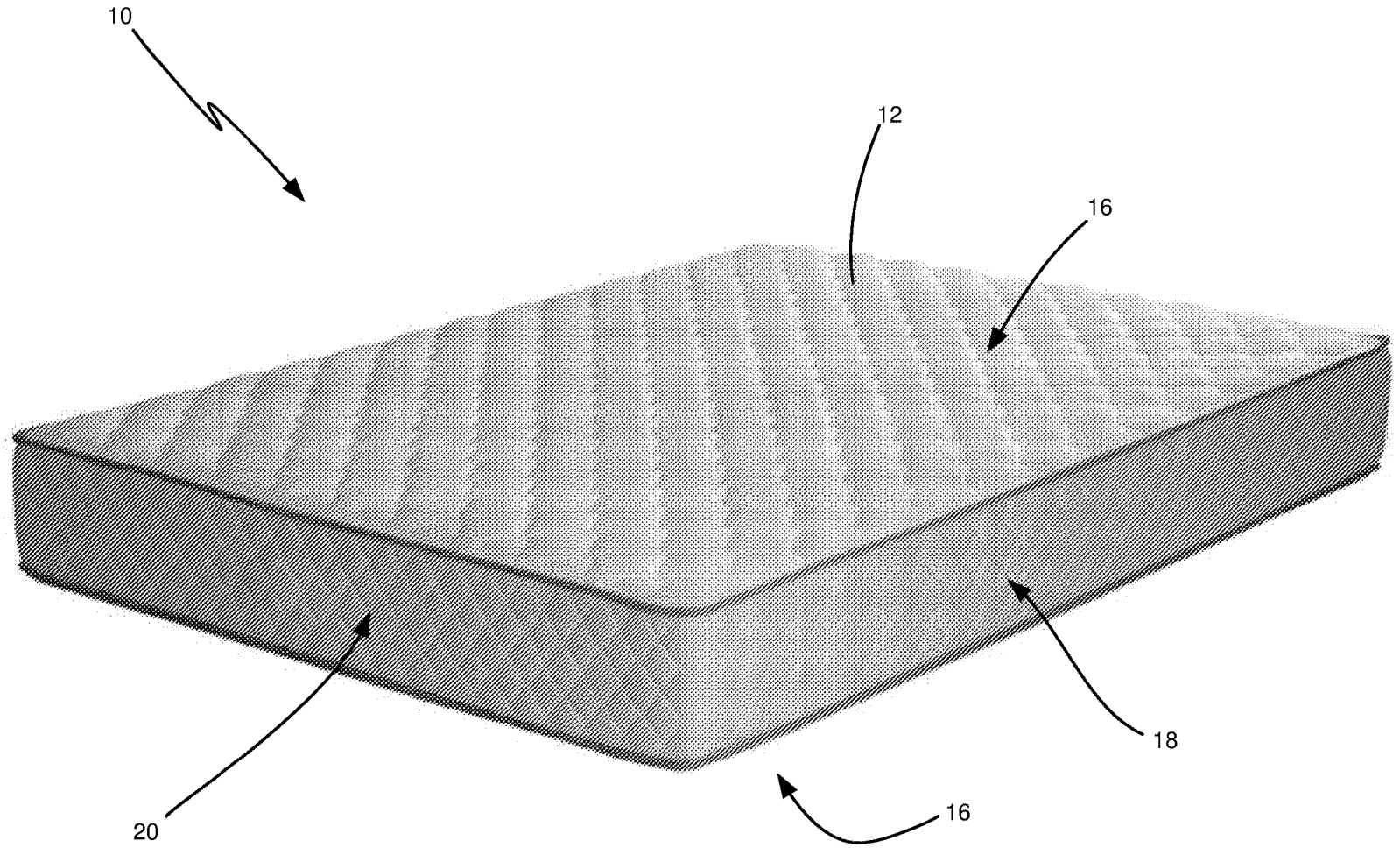
FIG. 1: is a perspective view of a mattress in accordance with a first embodiment of the present invention.

FIG. 1 shows a mattress 10 in accordance with a first embodiment of the present invention. The mattress 10 has an outer casing 12, and an inner core 14, which is shown schematically in FIGS. 2 to 6. The outer casing 12 surrounds the core 14 so as to provide comfort to users of the mattress 10, and to prevent access to the core 14.

The mattress 10 having two major faces 16, two long side faces 18, and two end faces 20. Thus, the mattress has a length (L), a width (W), and a depth (D). As may be apparent from the overall proportions of the mattress 10 shown in FIG. 1, the mattress 10 is of a size that suitable for two adults to sleep side-by-side. In other words, the mattress 10 may be suitable for a Double bed, a Queen-size bed, or a King-size bed. In the example illustrated in FIG. 1, the outer casing 12 on both major faces 16 has a construction that provides a sleeping face to each major face 16. Thus, the mattress 10 can be positioned in either orientation in use.

The core 14 includes a plurality of pocket springs 22. In this particular embodiment, each pocket spring is in the form of a coil spring that is contained within a fabric pocket. The fabric can be a non-woven material, such as for example a polyester. Each spring is compressible along a compressive axis. The pocket springs are arranged within the core 14 such that the compressive axes extend perpendicularly to the two major faces 16; in other words, parallel to the depth D direction of the mattress.

The pocket springs 22 are arranged within the core 14 into two lateral sets 24, 26, and a central set 28 that is positioned between the lateral sets 24, 26. Within each lateral set 24, 26, the fabric pockets of adjacent pocket springs 22 are interconnected in regions adjacent the major faces 16 of the mattress 10. Within the central set 28, the fabric pockets of adjacent pocket springs are interconnected in regions adjacent the major faces 16 of the mattress 10. As is apparent from FIG. 2, the central set 28 extends in a direction parallel to the long side faces 18 of the mattress 10. In addition, the central set 28 extends between the opposing end faces 20.

The core 14 also includes peripheral wires 30 that each extend around the periphery of one of the two major faces 16. Clips 32 connect the axial ends of outermost pocket springs 22 to the peripheral wires 30.

The central set 28 of pocket springs 22 is joined directly or indirectly to each of the two lateral sets 24, 26 by first connections that are disposed substantially centrally between the two major faces. As will be apparent from FIG. 4, the core 14 does not have any connections (direct or otherwise) between the central set 28 and each of the two lateral sets 24, 26 in the regions adjacent the major faces 16. The location of the first connections enables the pocket springs 22 in each lateral set 24, 26 to be compressible independently of the pocket springs 22 in the other lateral set 26, 24.

Figure 4:
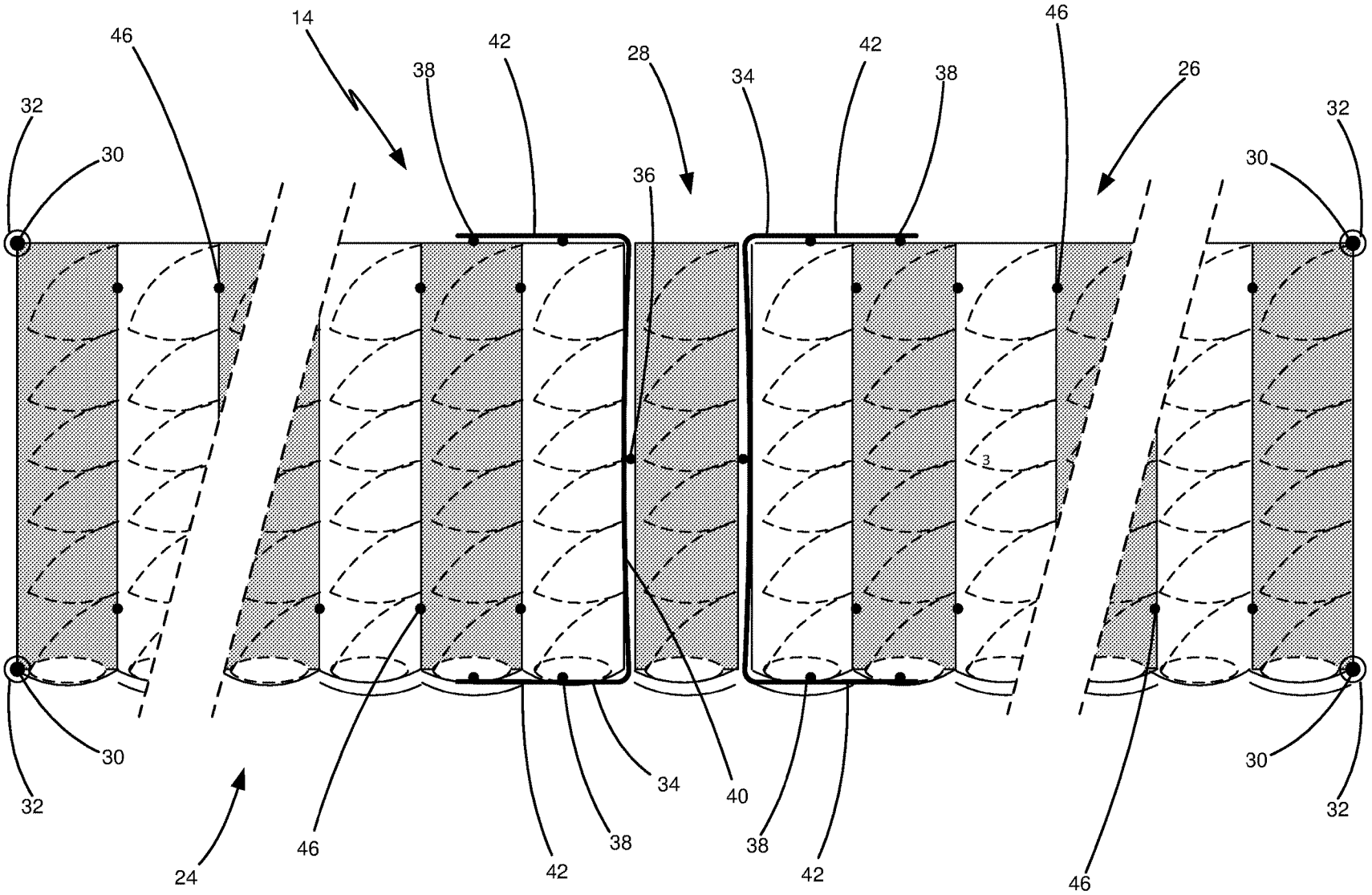
FIG. 4: is a cross section view of the inner core as viewed along the line IV-IV in FIG. 2.
Figure 5:
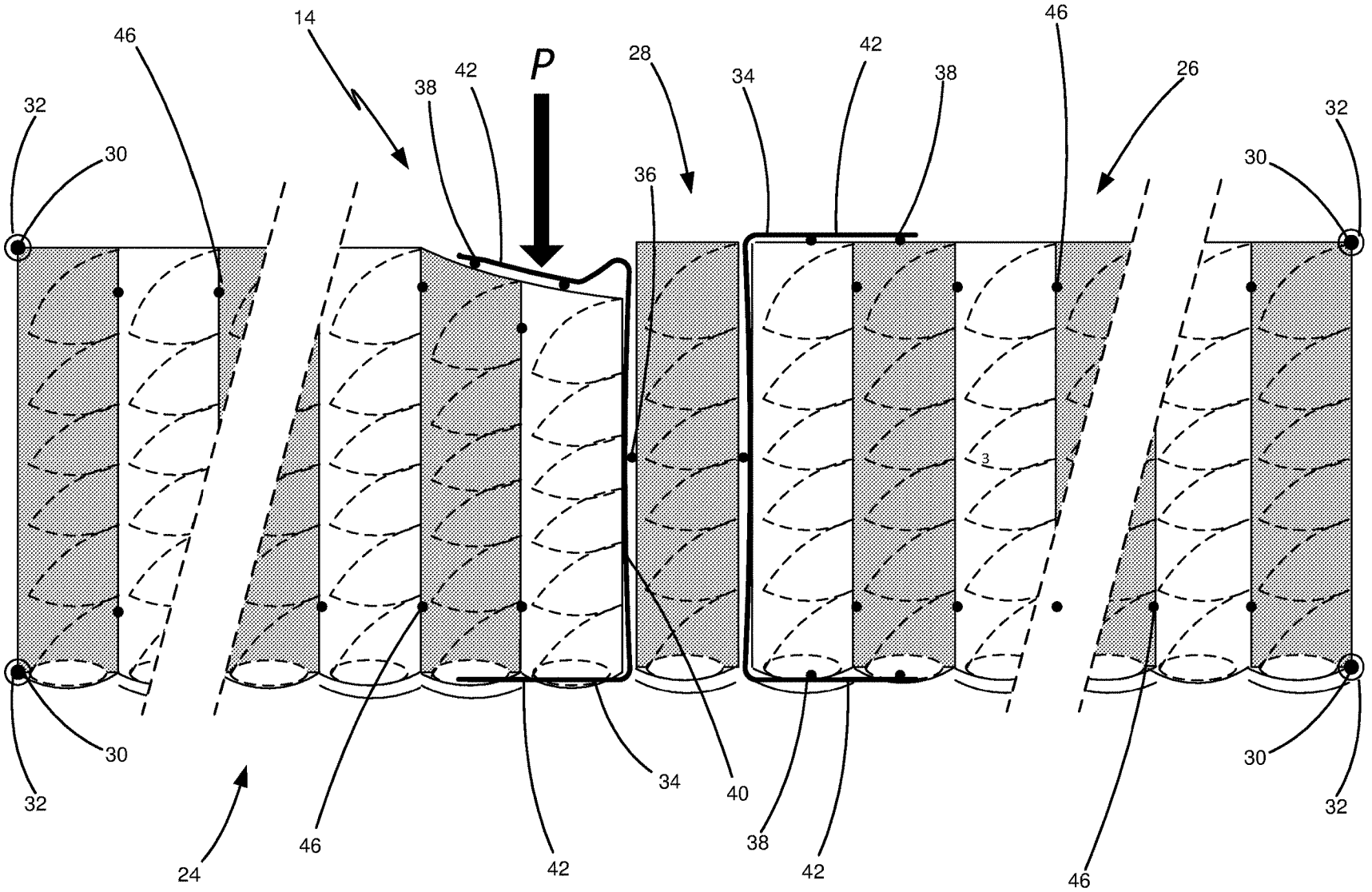
FIG. 5: is a cross section view of the inner core as viewed along the line IV-IV in FIG. 2, showing the inner core under a point load F.

FIG. 4 shows a cross section of the core 14, as viewed along the line IV-IV, with the pocket springs 22 in a neutral (uncompressed) state. FIG. 5 shows the same cross section of the core 14 with a point load P applied to the lateral set 24 immediately adjacent the central set 28. As is evident from FIG. 5, the pocket springs 22 of the lateral set 24 in a region surrounding the point load P are deflected by virtue of the interconnection of the pocket springs 22 in the lateral set 24. However, the pocket springs 22 in each of the central set 28 and the other lateral set 26 remain undeflected and in their neutral states. This "isolation" of movement in the central set and other lateral set 26 is achieved by virtue of the location of the first connections 36. In addition, this "isolation" is achieved by the absence of any connection between the lateral set 24 and the central set 28 in the region adjacent the major face 16 on which the point load P is applied.

As will be appreciated, this construction of the core 14 has the distinct advantage that there is negligible deflection in the pocket springs 22 of one of the lateral sets 24, 26, when the pocket springs 22 of the other of the lateral sets 24, 26 is moved. Consequently, a person moving on the major face 16 of the mattress 10 above one lateral set 24, 26 is unlikely to cause a movement in the other lateral set 26, 24, which could disturb a person on the major face 16 of the mattress 10 above that other lateral set 26, 24.

Figure 2:
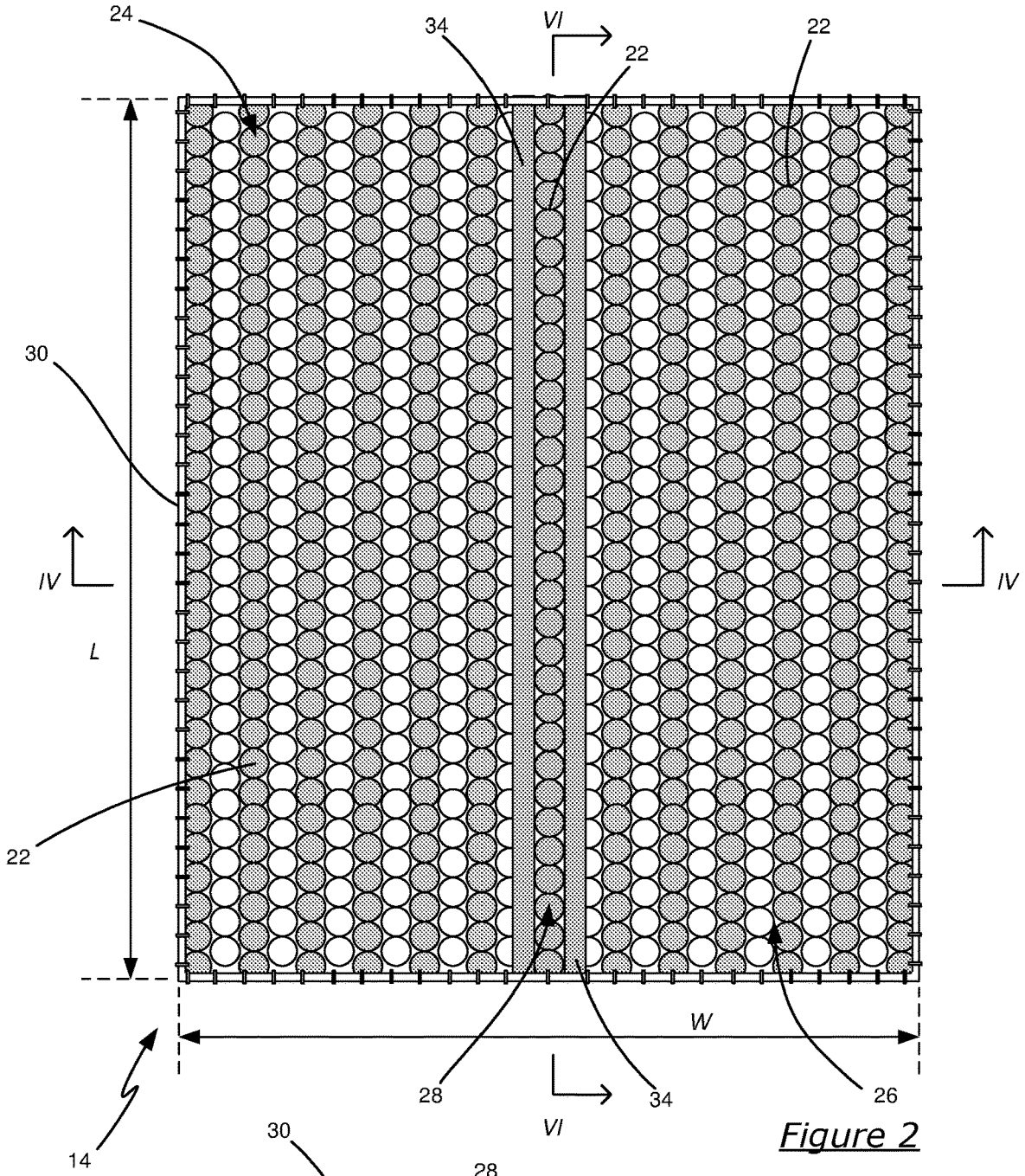
FIG. 2: is a plan view of an inner core of the mattress of FIG. 1.
Figure 3:
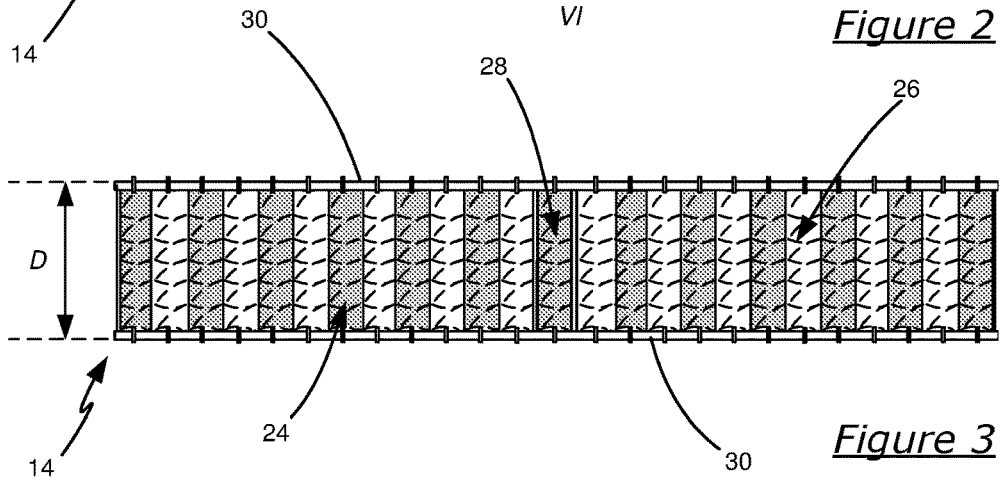
FIG. 3: is an end view of the inner core shown in FIG. 2.

As shown particularly in FIGS. 2, 4 and 5, the core 14 further includes two elongate flexible strips 34. In one example, the strips 34 can be made of the same non-woven fabric as that of the fabric pockets. Each strip 34 extends between the central set 28 and a respective one of the lateral sets 24, 26. The strips 34 extend in a direction that is generally parallel with the two long side faces 18. As shown in FIGS. 4 and 5, each of the first connections 36 connects the fabric pockets of the central set 28 with a respective one of the flexible strips 34. In addition, each strip 34 is joined to the respective lateral set 24, 26 by second connections 38 that are formed in a region adjacent at least one of the major faces 16 of the mattress 10.

Each elongate strip 34 has an inner portion 40 that is disposed between the central set 28 and respective lateral set 24, 26, and two outer portions 42 that each overlies portions of the respective lateral set 24, 26 on opposing major faces 16. In this particular embodiment, the outer portions 42 substantially overlie two rows of pocket springs of the respective lateral set 24, 26 that are beside the central set 28, as shown in FIG. 4. In FIG. 2, outer portions 42 of each strip 34 are shown overlying portions of the respective lateral sets 24, 26.

Each of the second connections 38 connects one of the outer portion 42 with fabric pockets of pocket springs 22 in the lateral sets 24, 26. To this end, each of the second connections 38 is formed at an axial end of the respective pocket spring 22.

Each elongate strip 34 can be made of a non-woven fabric/textile. In one example, the elongate strips 34 are made of a non-woven polyester.

As is evident from FIGS. 2 and 4, in this embodiment the central set 28 consists of a single row of interconnected pocket springs 22. Furthermore, in this particular embodiment, the central set 28 extends between opposing end faces 20 of the mattress 10. The lateral sets 24, 26 are formed of rows of interconnected pocket springs 22, with adjacent rows being interconnected to one another. In FIG. 2, the rows of interconnected pocket springs 22 are indicated by alternating white and grey colouring of the pocket springs 22 to facilitate visualization of the rows.

Figure 6:
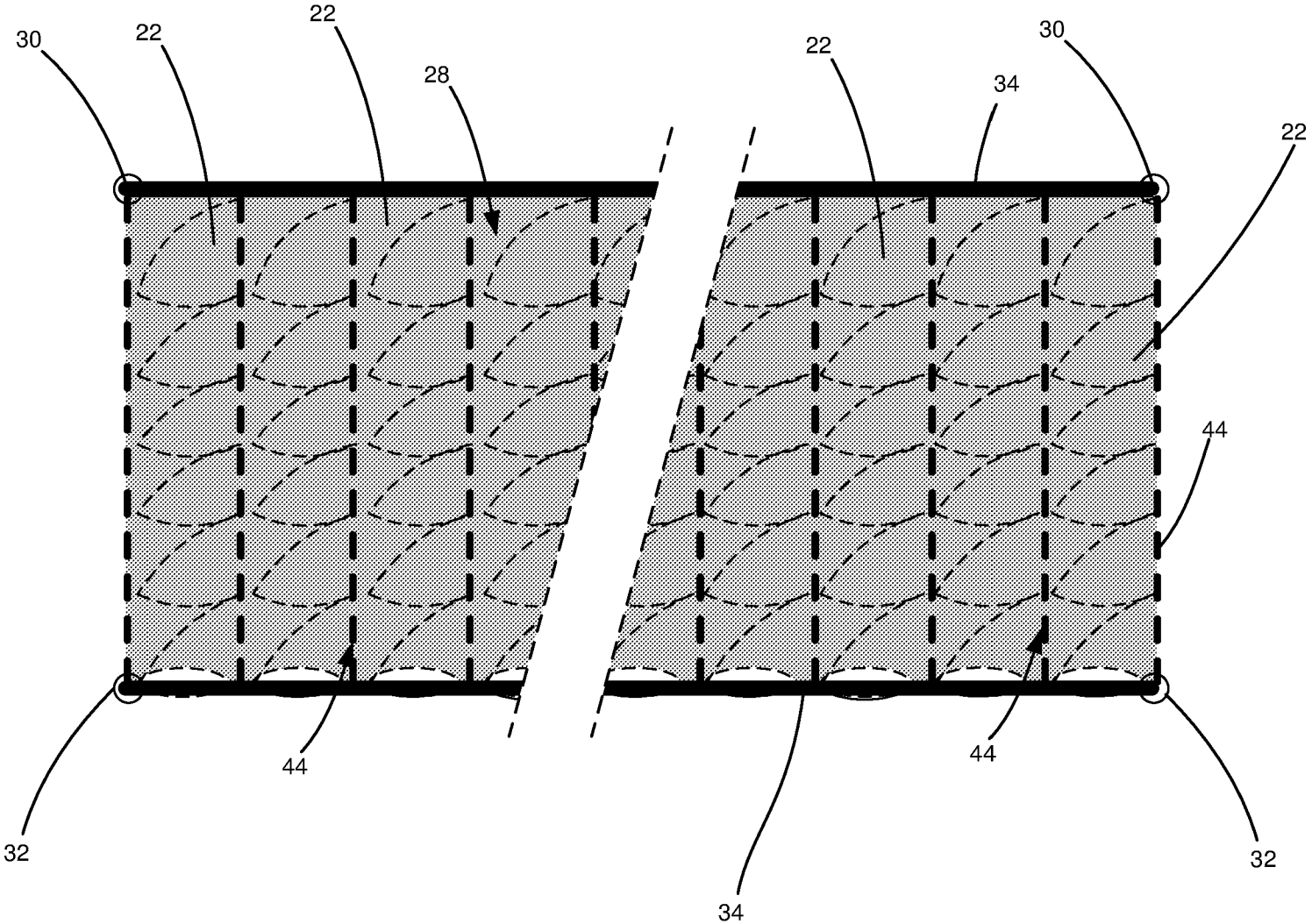
FIG. 6: is a cross section view of the inner core as viewed along the line VI-VI in FIG. 2.

Each row of pocket springs 22 in the central set 28, and in the lateral sets 24, 26 are formed from a tube of fabric that provides the fabric pocket. FIG. 6 shows a longitudinal cross section of the central set 28 of pocket springs 22. Seams 44 extend transversely across the tube and between each adjacent pair of coil springs. Thus, the tube is partitioned so as to form the fabric pockets. In one example, the fabric includes a plastic material and the seams are created between adjacent springs by a fabric fusing process. To this end, the tube fabric may be a non-woven fabric/textile. In one example, the tubes are made of a non-woven polyester. In this example, heat and pressure can be applied to fuse two pieces of the fabric to one another. As indicated in FIG. 6, the seams 44 extend substantially the full depth of the core 14, thus providing the interconnected in the regions adjacent the major faces 16 of the mattress 10.

In the embodiment of FIGS. 1 to 6, the rows of pocket springs 22 in the lateral sets 24, 26, which are defined by the tube construction, are arranged parallel to the central set 28 of pocket springs 22. In the embodiment shown in FIGS. 2 to 6, the rows of pocket springs 22 in each of the lateral sets 24, 26 are in an alternating offset arrangement in a length-wise direction. It will be appreciated that in some alternative embodiments, the rows of pocket springs 22 in each of the lateral sets 24, 26 may be aligned such that the coil springs in adjacent rows are in a side-by-side arrangement.

As shown in FIGS. 4 and 5, the fabric pockets of adjacent rows of pocket springs 22 in each lateral set 24, 26 are interconnected by a third connections 46. From FIGS. 4 and 5, it is evident that the third connections 46 connect the fabric pockets in regions adjacent the major faces 16 of the mattress 10. In this example, the third connections 46 extend along two lines that are each generally parallel to the adjacent major face 16, and spaced slightly internally of the core 14. The third connections 46 may be discontinuous along the respective line.

Both the seams 44 and third connections 46 provide the interconnections between the pocket springs 22 in each of the lateral sets 24, 26 that are in the regions adjacent the major faces 16 of the mattress 10.

The first, section and third connections 36, 38, 46 can be made using adhesives. Conveniently, the adhesive may be a holt-melt adhesive (which is commonly known as "hot-glue").

FIGS. 4 and 5 show the mattress core 14 as viewed along a vertical cross section along the line IV-IV in FIG. 2. FIG. 4 shows the core 14 in an unloaded state, in which the pocket springs 22 are all in a neutral state.

It will be appreciated that mattresses in accordance with embodiments of the present invention are not restricted to particular constructions of outer casing. For example, the outer casing may provide full or partial foam encasement. The outer casing may be constructed of a substantially incompressible fabric material(s). Mattresses in accordance with embodiments of the present invention may be of "Euro Top" or "Pillow Top" style.

Figure 7:
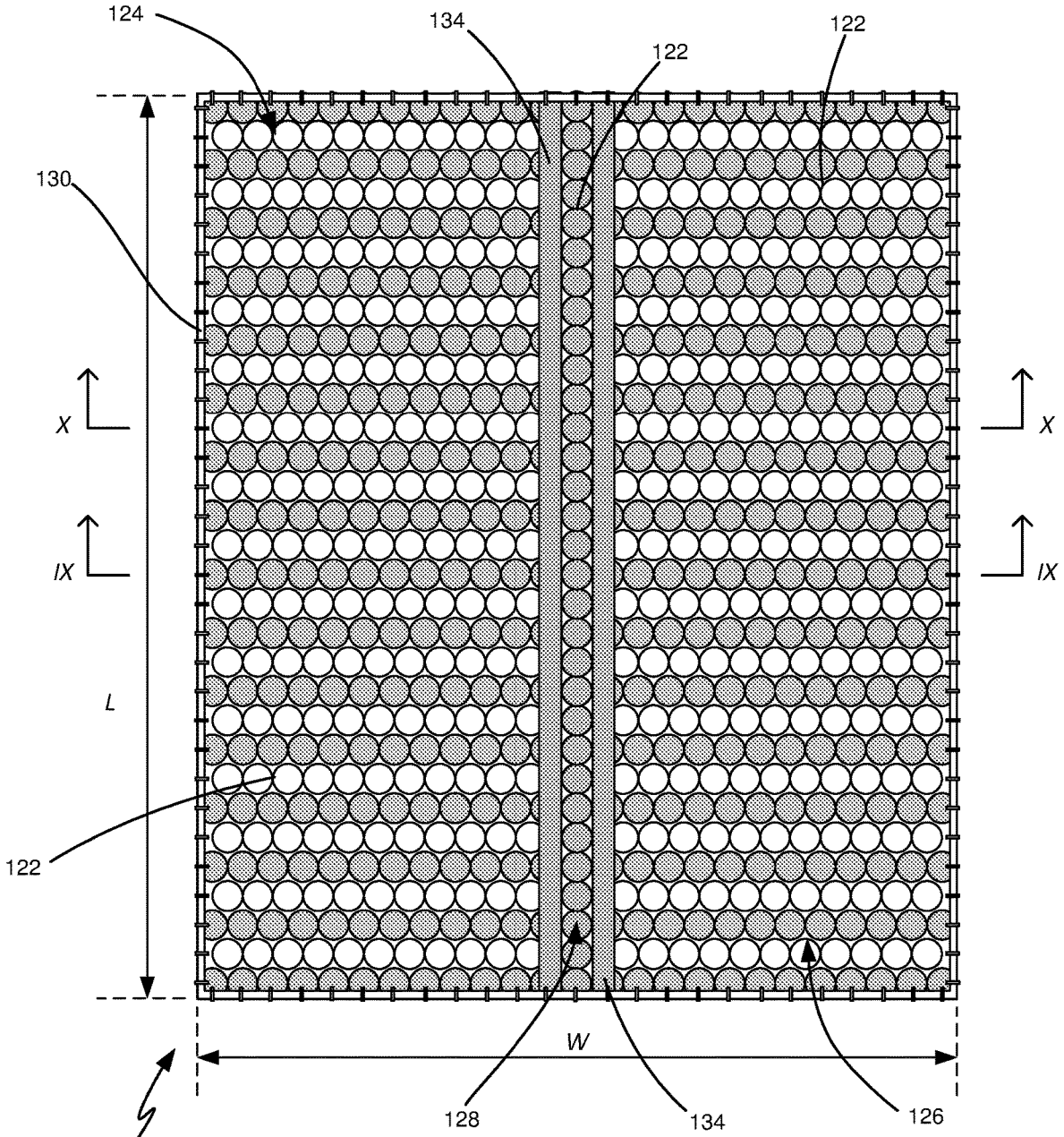
FIG. 7: is a plan view of an inner core of a mattress in accordance with a second embodiment of the present invention.
Figure 8:
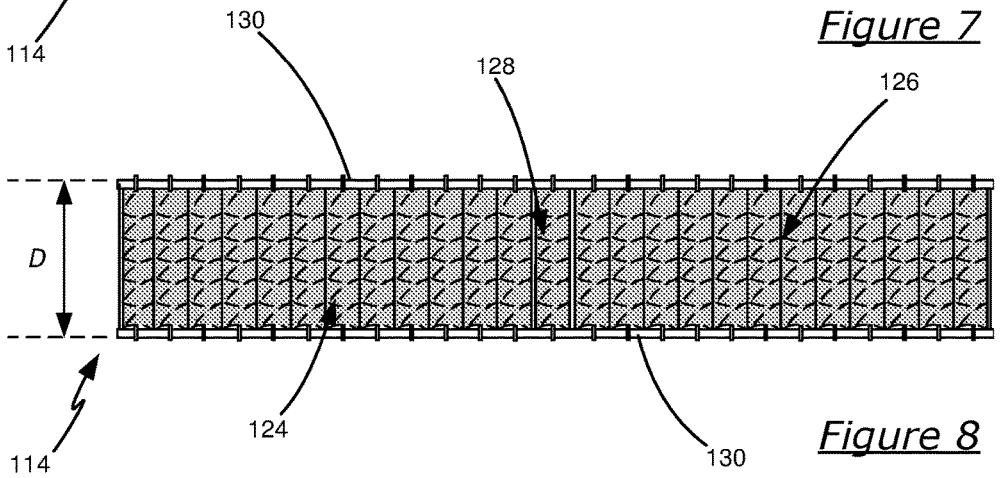
FIG. 8: is an end view of the inner core shown in FIG. 7.
Figure 9:
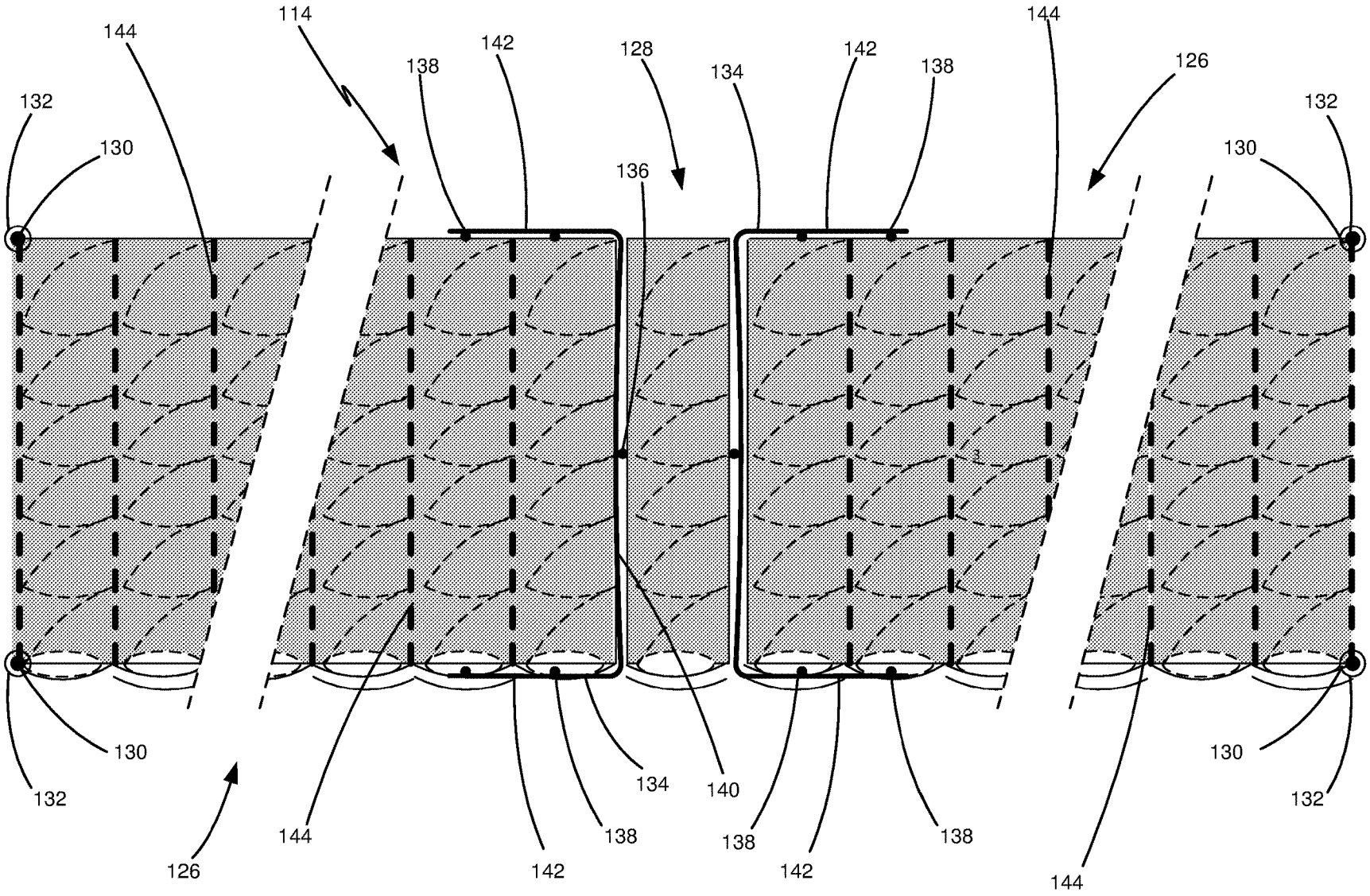
FIG. 9: is a cross section view of the inner core as viewed along the line IX-IX in FIG. 7.

FIGS. 7 to 9 shows schematically an inner core 114 of a mattress in accordance with a second embodiment of the present invention. The inner core 114 is substantially similar to the inner core 14 shown in FIGS. 2 to 6. In FIGS. 7 to 9, the features of the core 114 that are substantially similar to those of the core 14 have the same reference numeral with the prefix "1".

The principal difference between the inner cores of the two embodiments is that in the embodiment of FIGS. 7 to 9, the rows of pocket springs 122 in the lateral sets 124, 126, which are defined by the tube construction, are arranged perpendicularly to the central set 128 of pocket springs 122. In FIG. 7, the rows of interconnected pocket springs 122 are indicated by alternating white and grey colouring of the pocket springs 122 to facilitate visualization of the rows. In the embodiment shown in FIGS. 7 to 9, the rows of pocket springs 122 in each of the lateral sets 124, 126 are in an alternating offset arrangement in a length-wise direction. It will be appreciated that in some alternative embodiments, the rows of pocket springs 122 in each of the lateral sets 124, 126 may be aligned such that the coil springs in adjacent rows are in a side-by-side arrangement.

Figure 10:
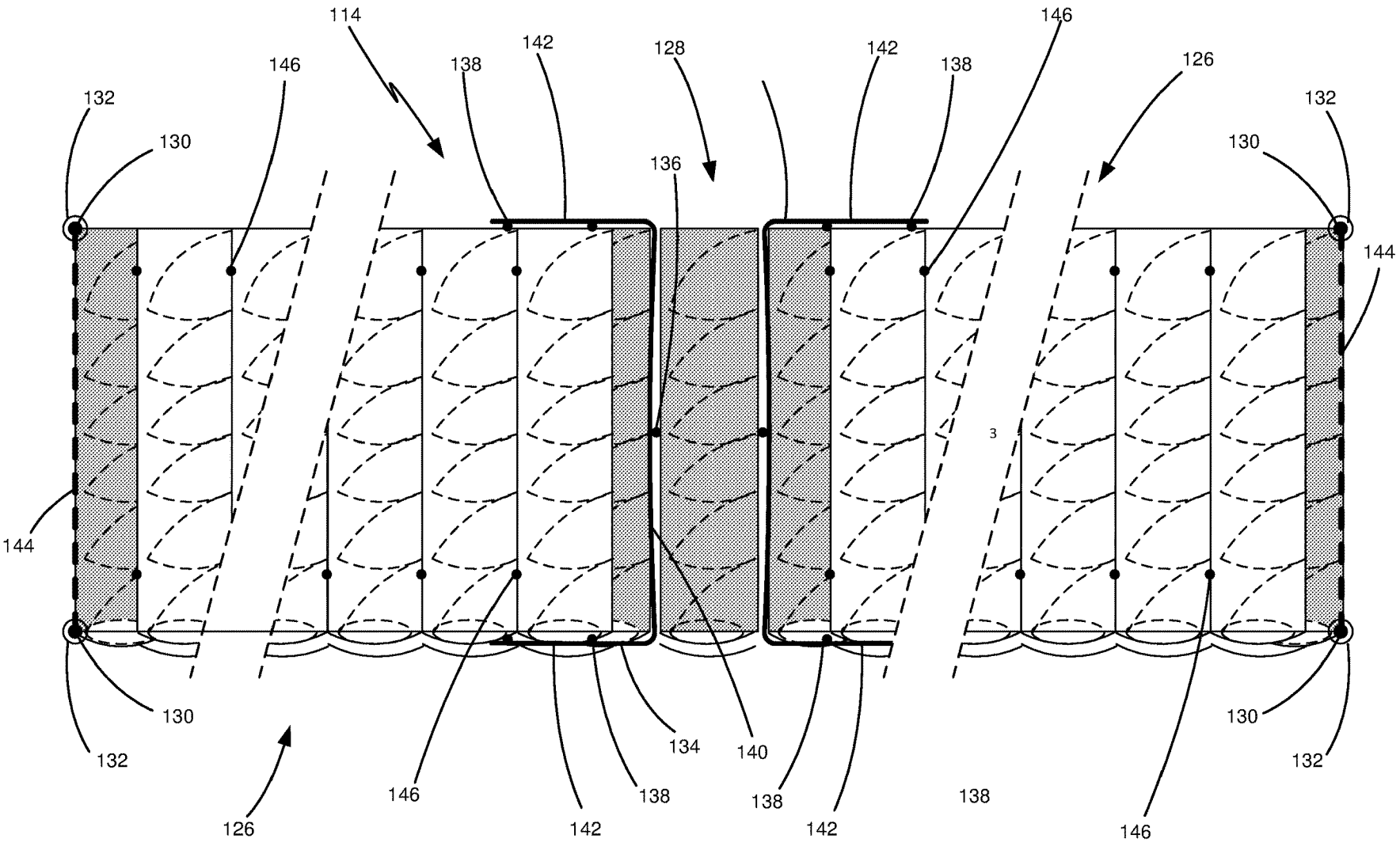
FIG. 10: is a cross section view of the inner core as viewed along the line X-X in FIG. 7.

FIG. 9 shows a vertical cross section along the line IX-IX in FIG. 7, and FIG. 10 shows a vertical cross section along the line X—in FIG. 7. In FIG. 9, the seams 144 extending substantially the full depth of the core 114 are visible. In FIG. 10, the third connections 146 that interconnect the pocket springs 122 in adjacent rows are visible. Both the seams 144 and third connections 146 provide the interconnections between the pocket springs 122 in each of the lateral sets 124, 126 that are in the regions adjacent the major faces 116 of the mattress 110. Further, because adjacent rows of pocket springs in the lateral sets 124, 126 are offset with respect to each other, a portion of a row having seams 144 are visible in FIG. 10.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention has been described by way of non-limiting example only and many modifications and variations may be made thereto without departing from the spirit and scope of the invention.

The invention claimed is:

1. A mattress comprising an outer casing, and an inner core that is surrounded by the outer casing, the mattress having two major faces, two long side faces, and two end faces, the core including a plurality of pocket springs that each comprise at least one spring within a fabric pocket, each spring being compressible along a compressive axis, and the pocket springs being arranged within the core such that the compressive axes extend perpendicularly to the two major faces, wherein the pocket springs are arranged into:

two lateral sets, wherein in each lateral set the fabric pockets of adjacent pocket springs are interconnected in regions adjacent the major faces of the mattress; and a central set, wherein the fabric pockets of adjacent pocket springs in the central set are interconnected in regions adjacent the major faces of the mattress, the central set being disposed between the two lateral sets, and extending in a direction parallel to the long side faces of the mattress;

and wherein the central set is joined to each of the two lateral sets by first connections that are disposed midway between the two major faces, such that the pocket springs in each lateral set are compressible independently of the pocket springs in the other lateral set;

and wherein the core further includes at least two elongate flexible strips, wherein each elongate flexible strip extends between the central set and a respective one of the lateral sets, wherein each of the first connections connects the fabric pockets of the central set with a respective one of the elongate flexible strips, and wherein each elongate flexible strip is joined to the respective lateral set by second connections that are formed in a region adjacent at least one of the major faces of the mattress.

2. The mattress according to claim 1, wherein the elongate flexible strips each include an inner portion that is disposed between the central set and lateral sets, and at least one outer portion that overlies a portion of the respective lateral set.

3. The mattress according to claim 2, wherein the second connections are disposed between the respective lateral set and outer portion, and also between the respective lateral set and the adjacent major face of the mattress.

4. The mattress according to claim 2, wherein the elongate flexible strips each include two outer portions that each overlies portions of the respective lateral set on opposing major faces of the core.

5. The mattress according to claim 2, wherein the outer portions overlie at least one row of pocket springs of the respective lateral set that is beside the central set.

6. The mattress according to claim 2, wherein each of the second connections is formed at an axial end of the respective pocket spring.

7. The mattress according to claim 1, wherein the elongate flexible strips are formed of a fabric.

8. The mattress according to claim 1, wherein the central set consists of a single row of interconnected pocket springs.

9. The mattress according to claim 1, wherein the central set extends between opposing end faces of the mattress.

10. The mattress according to claim 1, wherein the central set is formed from a tube of fabric that has seams extending transversely across the tube and between adjacent springs to partition the tube so as to form the fabric pockets.

11. The mattress according to claim 1, wherein the lateral sets are each formed from a plurality of tubes of fabric, each tube having seams extending transversely between adjacent springs to partition the respective tube so as to form the fabric pockets, and wherein the fabric pockets of adjacent pairs of the plurality of tubes are interconnected by a third connections that connect the fabric pockets in regions adjacent the major faces of the mattress.

12. The mattress according to claim 11, wherein the tubes of fabric in the lateral sets are arranged to extend parallel to the end faces of the mattress.

13. The mattress according to claim 11, wherein the tubes of fabric in the lateral sets are arranged to extend parallel to the long sides of the mattress.

14. A mattress comprising an outer casing, and an inner core that is surrounded by the outer casing, the mattress having two major faces of which at least one is a sleeping face, two long side faces, and two end faces, the core including a plurality of pocket springs that each comprise at least one spring within a fabric pocket, each spring being compressible along a compressive axis, and the pocket springs being arranged within the core such that the compressive axes extend perpendicularly to the two major faces, wherein the pocket springs are arranged into:

two lateral sets, wherein in each lateral set the fabric pockets of adjacent pocket springs are interconnected in regions within the core adjacent the major faces of the mattress; and a central set, wherein the fabric pockets of adjacent pocket springs in the central set are interconnected in regions within the core adjacent the major faces of the mattress, the central set being disposed between the two lateral sets, and extending in a direction parallel to the long side faces of the mattress;

and wherein the central set is joined to each of the two lateral sets by first connections that are spaced from the or each sleeping face and wherein the central set is not connected to either lateral set in a region within the core adjacent the or each sleeping face, and wherein the core further includes at least two elongate flexible strips, wherein each elongate flexible strip extends between the central set and a respective one of the lateral sets, wherein each of the first connections connects the fabric pockets of the central set with a respective one of the elongate flexible strips, and wherein each elongate flexible strip is joined to the respective lateral set by second connections that are formed in a region adjacent at least one of the major faces of the mattress.

15. The mattress according to claim 14, wherein the elongate flexible strips each include an inner portion that is disposed between the central set and lateral sets, and at least one outer portion that overlies a portion of the respective lateral set.

16. The mattress according to claim 14, wherein the elongate flexible strips are formed of a fabric.

* * * * *